United States Patent [19]

Powlenko

[11] Patent Number: 4,702,408

[45] Date of Patent: Oct. 27, 1987

[54] BULK BIN

[75] Inventor: Edward J. Powlenko, Cincinnati, Ohio

[73] Assignee: The Mead Corporation, Dayton, Ohio

[21] Appl. No.: 867,245

[22] Filed: May 23, 1986

[51] Int. Cl.[4] ..... B65D 5/10

[52] U.S. Cl. ..... 229/101; 229/109; 229/157; 229/185; 229/199; 229/920

[58] Field of Search ..... 229/101, 109, 110, 156, 229/157, 920, 8, 23 R, 41 C, 185, 199

[56] References Cited

U.S. PATENT DOCUMENTS

| | | | |
|---|---|---|---|
| 1,160,760 | 11/1915 | Rexford | 229/199 |
| 1,527,021 | 2/1925 | Wandel | 229/199 |
| 1,892,714 | 1/1933 | Wellman | 229/109 |
| 1,914,845 | 6/1933 | Cook | 229/199 |
| 2,000,210 | 5/1935 | Bayless | 229/110 |
| 2,123,147 | 7/1938 | Snyder | 229/110 |
| 2,156,999 | 5/1939 | McNeil | 229/109 |
| 2,340,473 | 2/1944 | Johnson | 229/8 |
| 2,361,603 | 10/1944 | Cohen et al. | 229/157 |
| 3,032,253 | 5/1962 | Younger | 229/101 |
| 3,251,533 | 5/1966 | Cohen | 229/23 R |
| 3,306,517 | 2/1967 | Diesinger, Jr. | 229/199 |
| 3,934,791 | 1/1976 | Dick et al. | 229/132 |
| 3,990,600 | 11/1976 | Rossitto et al. | 220/1 B |
| 4,119,266 | 10/1978 | Dempster | 229/109 |
| 4,160,519 | 7/1979 | Gorham | 229/199 |
| 4,361,267 | 11/1982 | Wozniacki | 229/109 |
| 4,392,607 | 7/1983 | Perkins, Jr. | 229/185 |
| 4,398,650 | 8/1983 | Holmes et al. | 229/DIG. 2 |
| 4,583,678 | 4/1986 | Weimer, Jr. | 229/185 |

*Primary Examiner*—Stephen Marcus
*Assistant Examiner*—Gary E. Elkins
*Attorney, Agent, or Firm*—Rodgers & Rodgers

[57] ABSTRACT

A bulk bin is formed of a unitary sheet of corrugated paperboard and includes foldably joined side, end, and corner panels forming an open top structure of polygonal cross sectional configuration and having bottom structure comprising a pair of primary bottom closure panels foldably joined respectively to the bottom edges of the side panels and having abutting inner edges, a bottom closure flap foldably joined to the bottom edge of each of the corner panels and disposed in flat face contacting relation with one of the primary bottom closure panels, a pair of bottom locking panels foldably joined respectively to the bottom edges of the end panels and folded into flat face contacting relation with the bottom closure flaps and with the primary bottom closure panels and interlocked with the primary bottom closure panels to secure the bottom closure flaps between the primary bottom closure panels and the bottom locking panels.

6 Claims, 9 Drawing Figures

BULK BIN

TECHNICAL FIELD

This invention relates to a bulk bin for use primarily in the meat industry for the shipment of heavy quantities of fabricated cuts of fresh meat. Preferably the bin is an open top structure of polygonal cross sectional configuration in which a large heavy duty plastic bag is disposed which is tied off to isolate its contents from the enviroment.

BACKGROUND ART

U.S. Pat. 4,382,537 issued May 10, 1983 discloses an octagonal bulk bin formed of a unitary sheet of material including side, end, and corner panels together with bottom flaps foldable inwardly to form a bottom. This patent requires time consuming manipulations of the bottom flaps and the octagonal cnfiguration of the structure is not positively established and maintained by the bottom flaps.

DISCLOSURE OF THE INVENTION

According to this invention in one form, a bulk bin is formed from a unitary sheet of material having foldably joined side, end and corner panels arranged in octagonal configuration together with bottom closure structure including a pair of primary bottom closure panels which are foldably joined respectively to the bottom edges of the side panels and arranged with their inner edges in abutting relationship to each other, the sides of these primary bottom closure panels being configured and arranged to cooperate with bottom closure flaps foldably joined to the bottom edges of the corner panels and engageable with the side edges of the primary bottom closure panels so as automatically to ensure that the bin when set up is of the desired octagonal cross sectional configuration and the bottom closure panels are interrelated with a pair of bottom locking panels which underlie the primary bottom closure panels and the bottom closure flaps and which are interlocked with the primary bottom closure panels to secure the bottom closure flaps between the primary bottom closure panels and the bottom locking panels.

BEST MODE OF CARRYING OUT THE INVENTION

Figure 1:
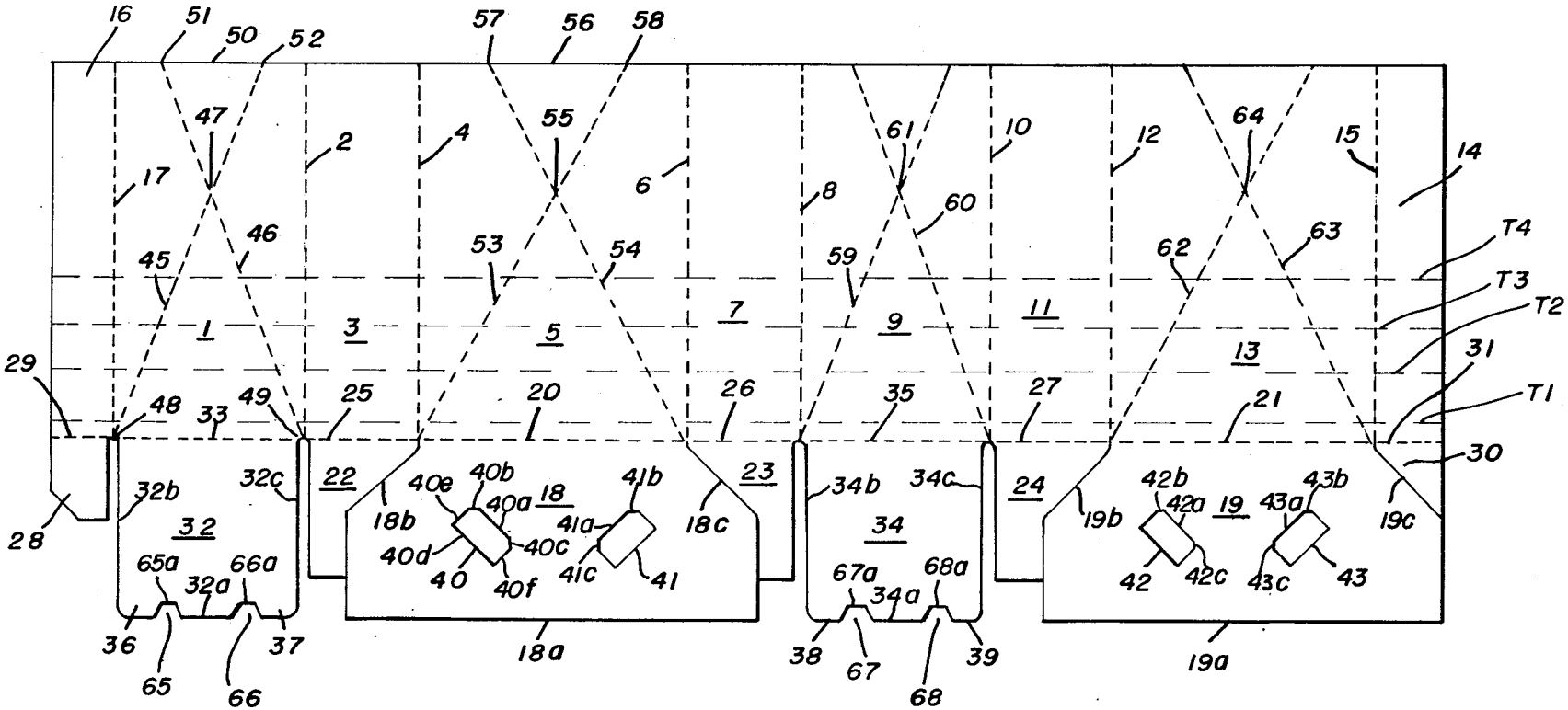
FIG. 1 is a plan view of one form of a unitary blank from which the bulk bin of this invention is formed.

In the drawings the numeral 1 designates an end wall panel which is foldably joined along fold line 2 to corner panel 3 which in turn is foldably joined along fold line 4 to side panel 5. Side panel 5 is foldably joined along fold line 6 to the corner panel 7 which in turn is foldably joined along fold line 8 to end panel 9. End panel 9 is foldably joined along fold line 10 to corner panel 11 which in turn is foldably joined along fold line

12 to side panel 13. A glue flap 14 is foldably joined along a fold line 15 to a side edge of side panel 13 while a glue flap 16 is foldably joined along fold line 17 to a side edge of end wall panel 1.

Figure 2:
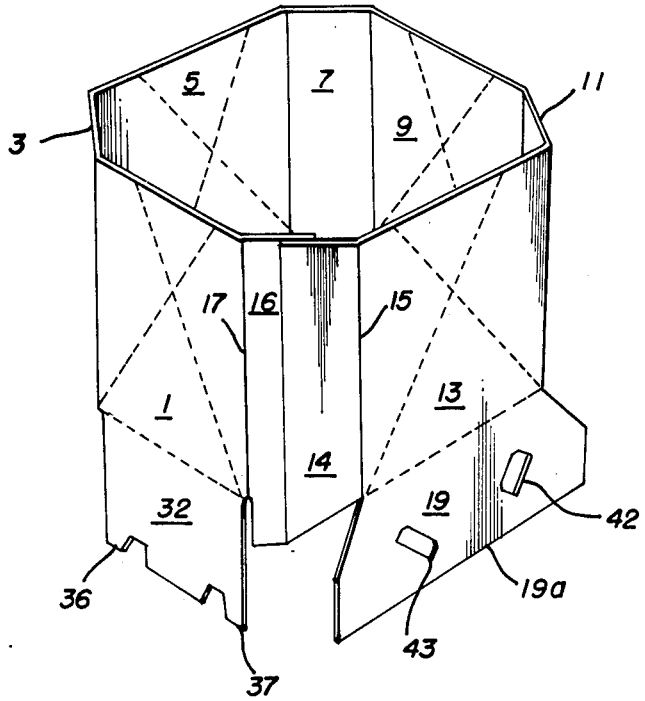
FIGS. 2, 3, 4 and 5 depict manipulative steps through which the blank of FIG. 1 is folded so as to form the complete bin as shown from above in FIG. 7 and as shown from above in FIG. 8, FIG. 6 representing an enlarged view of the interlocking relationship between certain bottom components.

In order to form the octagonal carton as shown in FIG. 2 from the blank depicted in FIG. 1 glue flap 14 is secured to panel 16 by adhesive applied to the outer surface of panel 16.

As is clear from FIG. 2, the overlapping portions of glue flaps 14 and 16 are disposed approximately midway between the side edges 15 and 17 to form a composite corner panel. The fact that the overlapped portions of glue flaps 14 and 16 are disposed approximately midway between the side edges 15 and 17 contribute substantially to the mechanical stability of the composite corner panel formed of glue flaps 14 and 16.

The bottom structure of the bin includes primary bottom closure panels 18 and 19 which are foldably joined to the bottom edges of side walls 5 and 13 along fold lines 2 and 21. Bottom closure flaps 22, 23, and 24 are foldably joined to the bottom edges 25, 26 and 27 of corner panels 3, 7 and 11 respectively. A composite closure flap includes closure flap 28 which is foldably joined to glue flap 16 along fold line 29 as well as closure flap 30 foldably joined to lap panel 14 along fold line 31. As is apparent from FIG. 2 closure flaps 30 and 28 are secured together by means of glue on the outer surface of closure flap 28.

Bottom locking panel 32 is foldably joined to the bottom edge of end panel 1 along a fold line 33 while bottom locking panel 34 is foldably joined to the bottom edge of end panel 9 along fold line 35. Locking panel 32 includes corner locking tabs 36 and 37 while bottom locking panel 34 includes corner locking tabs 38 and 39.

For receiving the locking tabs 36, 37, 38 and 39, hexagonal slots 40 and 41 are diagonally formed in primary bottom closure panel 18 while similar diagonally disposed hexagonal locking slots 42 and 43 are formed in primary bottom closure panel 19.

Figure 3:
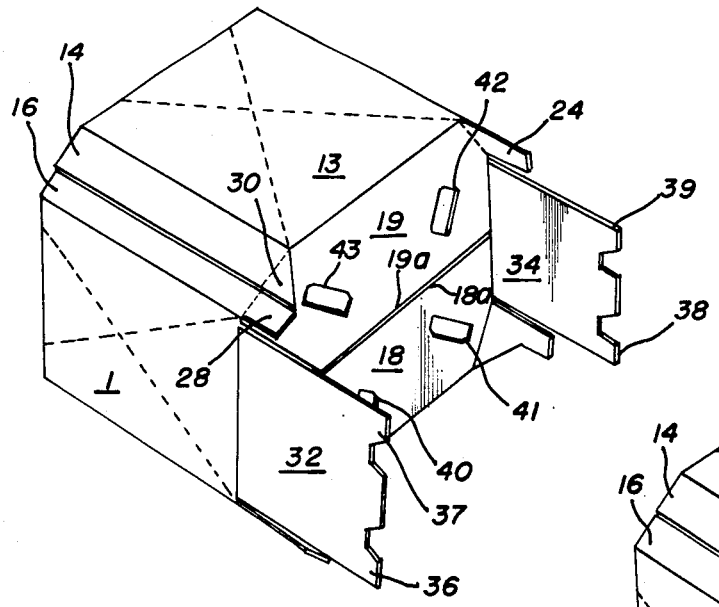
Figure 4:
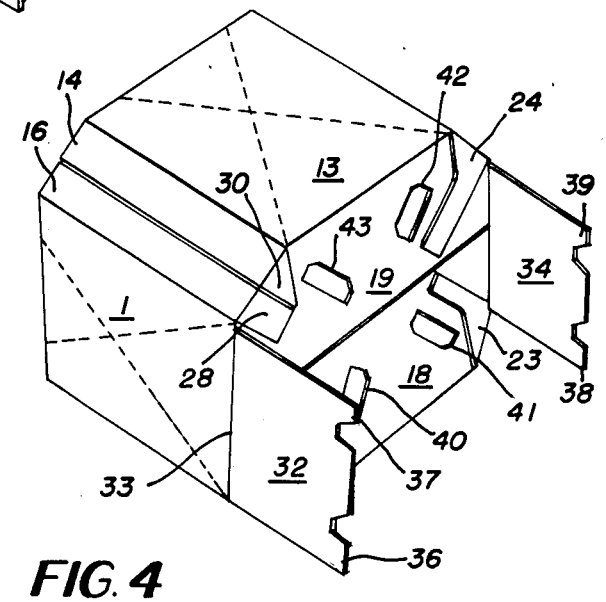

In order to form the bottom of the bin, the primary bottom closure panels are first folded inwardly from the position represented in FIG. 2 to the positions represented in FIG. 3 so that their edges **18*a*, 19*a* are disposed in close proximity and preferably abutting relation to each other as shown in FIG. 3. Thereafter the bottom closure flaps 22, 23, 24 and 28, 30 are folded inwardly into face contacting relation with the bottom surfaces of the primary bottom closure panels 18 and 19 as shown in FIG. 4. In this connection, cooperation between the angularly disposed side edges 18*b* and 18*c* of primary bottom closure panel 18 with the fold lines 25 and 26 respectively ensures that the structure including the side, end and corner panels defines an octagonal cross sectional configuration. Of course the cooperation between edges 19*b* and 19*c* of primary bottom closure panel 19 with the fold lines 27 and 29, 31** respectively functions in a similar fashion to ensure a cross sectional configuration of the wall panels which is octagonal. Not only does this cooperation ensure the formation of an octagonal configuration of the wall panels, it contributes significantly in maintaining that configuration even under loaded conditions of the bin.

Figure 5:
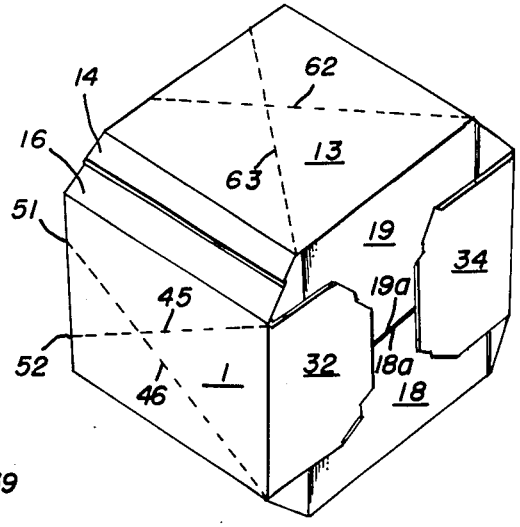
Figure 6:
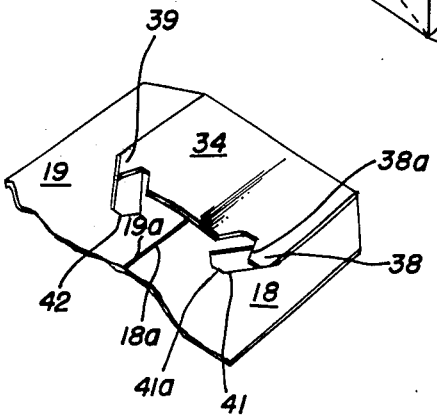

In order to complete the formation of the bottom of the bin, the bottom locking panel 32 is folded inwardly along fold line 33 to cause the corner locking tabs 36 and 37 to enter the hexagonal locking slots 40 and 43 respectively formed in primary bottom closure panels 18 and 19. Simultaneously bottom locking panel 34 is folded inwardly along fold line 35 to cause its corner locking tabs 38 and 39 to enter the diagonal hexagonal locking slots 41 and 42 respectively. Preferably these folding operations of bottom locking panels 32 and 34 should be through a substantial angle to ensure that the locking tabs seat securely within their associated locking slots. Ordinarily this folding operation causes panels 32 and 34 to swing inwardly beyond their normal horizontal finished positions by some thirty degrees. Once this latter folding operation is completed the bin appears as shown in FIG. 5. Set-up, erection and locking of the flaps is easily and quickly performed by a single operator without the use of any tools, fixtures or jigs.

The common overall physical size of a typical bin is approximately forty-eight inches in length by forty inches in width by forty-two inches in depth and gross weight of a loaded bin is normally in excess of two thousand pounds.

For substantially enhancing the stability and security of the bin and as shown in FIG. 1, the diagonal corners such as 40*b* and 40*c* of slot 40 constitute truncated corners of the generally rectangular slot 40 having generally parallel side edges 40*a* and 40*d* together with ends 40*e* and 40*f*. These truncated corners are specially configured to cooperate with parts of the bottom locking panels.

As is apparent from FIG. 1, the bottom locking panel 32 includes notch 65 having a base 65*a* and a notch 66 having a base 66*a*. In addition to the edge 32*b*, bottom locking panel 32 includes an edge 32*c*.

In addition to the generally rectangular locking slot 40 which is formed in bottom closure panel 18, a diagonally disposed generally rectangular locking slot 41 is also formed in bottom closure panel 18 and includes truncated corners 41*b* and 41*c*.

Bottom locking panel 34 includes locking notches 67 and 68 having base lines 67*a* and 68*a* respectively and the side edges of bottom locking panel 34 are designated by the numerals 34*b* and 34*c*.

Bottom closure panel 19 includes diagonally disposed generally rectangular locking slot 42 having truncated corners 42*b* and 42*c* while diagonal generally rectangular locking slot 43 includes truncated corners 43*b* and 43*c*.

Figure 9:
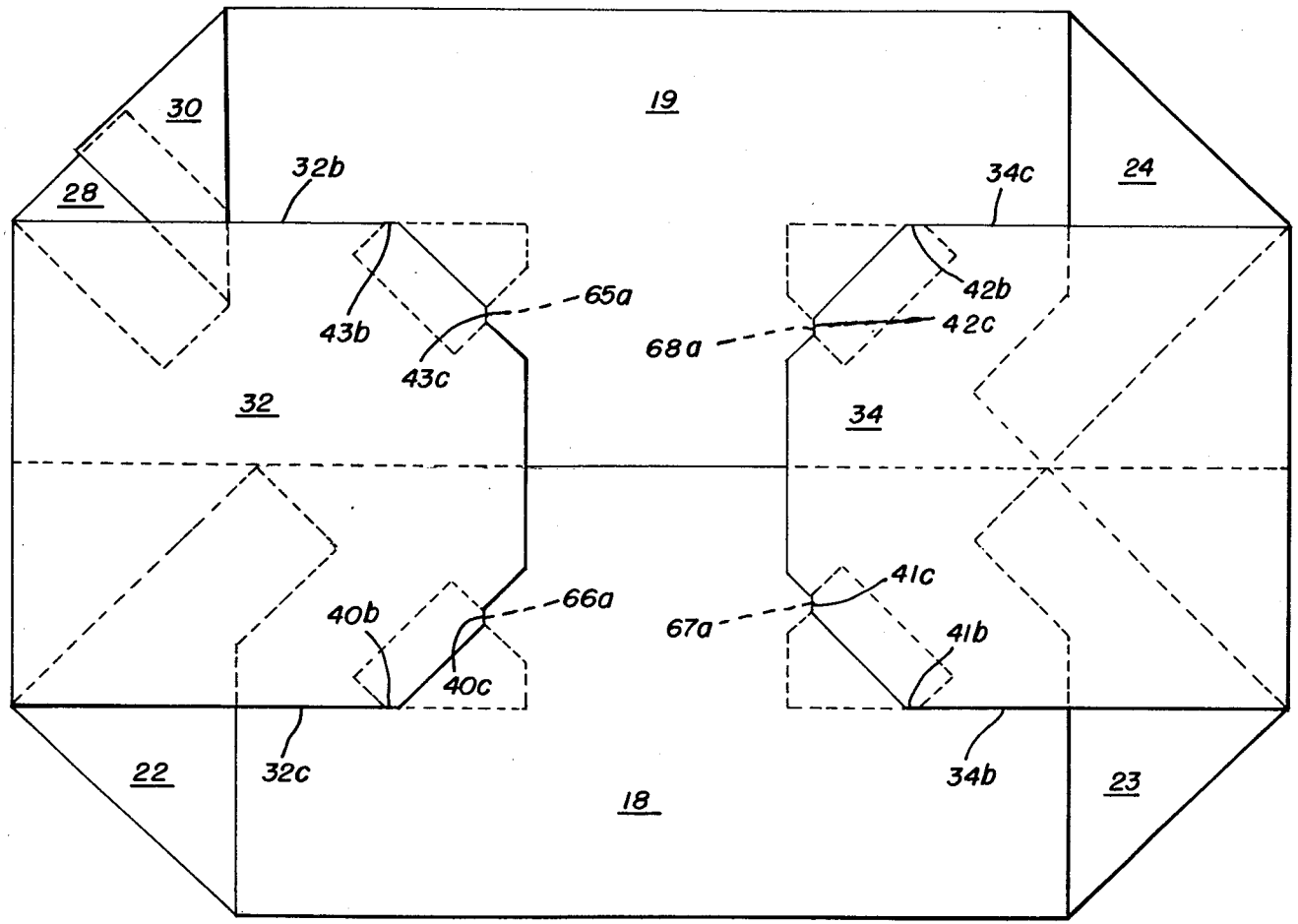
FIG. 9 is a view from below showing bottom locking panels overlying bottom closure flaps which in turn overly the primary bottom closure panels.

When the blank of FIG. 1 is manipulated into set up condition as shown for example in FIG. 5, the edges such as 32*b* and 32*c* of bottom locking panel 32 and edges 34*b* and 34*c* of bottom locking panel 34 as well as the base lines such as 65*a* and 66*a* and 67*a* and 68*a* are disposed in abutting coinciding intimate contact with truncated corners of the locking slots formed in bottom closure panels 18 and 19 as shown in FIG. 9. For example, edge 32*b* abuts truncated corner 43*b* while base 65*a* is in abutting engagement with truncated corner 43*c*. Edge 34*c* is in abutting engagement with truncated corner 42*b* while base 68*a* is in abutting contact with truncated corner 42*c*. Similarly edge 32*c* abuts truncated corner 40*b* while base 66*a* abuts truncated corner 40*c*. In like fashion, edge 34*b* abuts truncated corner 41*b* while base 67*a* abuts truncated corner 41*c*.

It should be observed that truncated corners such as 40*b*, 41*b*, 42*b* and 43*b* are approximately parallel to the bottom edges such as 20 and 21 of the side walls 5 and 13 respectively. Also it is apparent that the truncated corners such as 40*c*, 41*c*, 42*c* and 43*c* are approximately perpendicular to the fold lines 20 and 21.

Thus abutting contacts between the base lines 65*a*, 66*a*, 67*a* and 68*a* with those truncated corners which are perpendicular to the fold lines such a 20 and 21 together with abutting contact of the side edges such as 32*b*, 32*c*, 34*b* and 34*c* with those truncated corners which are generally parallel to the bottom edges such as 20 and 21 of side walls 5 and 13 result in a secure and sturdy interlocked structure which is particularly stable and which forms a mechanically strong bottom closure for the bin.

Figure 7:
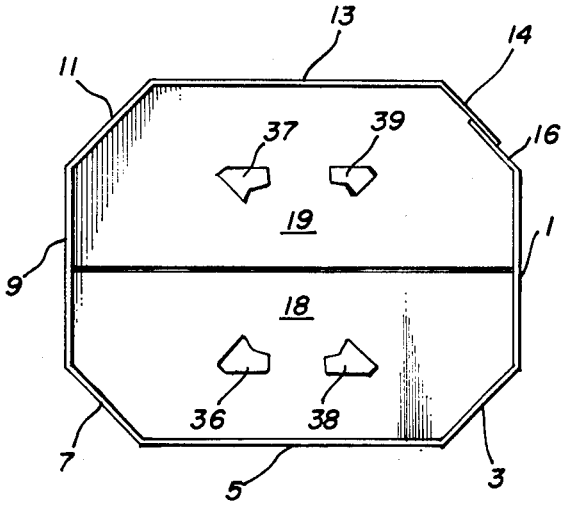

The fully set up bin is shown from above in FIG. 7 in unloaded condition. As shown in the view from above in FIG. 7, the primary bottom closure panels form the inside bottom surface of the container. The essentially smooth surface minimizes the possibility of abrasion and lacerations to the bottom of the heavy duty plastic bag and thus avoids leaking of any liquid purge.

The semi-flowable nature of fresh meat products causes the bulk bin to bulge. The tendency to bulge is especially accentuated during vibrations and impacts which occur during handling and transportation. These physically accelerated stresses and strains tend to cause tearing and failure at the panel creases. To insure complete container integrity against such hazards, the container is reinforced with internally applied synthetic fiber tape or plastic string. Normally four heat activated fiber tapes or eight heat activated plastic strings are introduced into the corrugated board as the container sheets are being combined on the corrugator. The reinforcing elements are fed into the board at the double-backer station of the corrugator and are positioned between the outer flute tips and the inside of the outer linerboard. Heat from the hot plates on the corrugator activates the reinforcements and seals them in position. The resulting amalgamation provides peripheral reinforcing girdles strategically positioned around the box structure. It is sufficient to prevent inadvertent tearing and failure by concentrating more reinforcing straps or strings in the bottom half of the container walls as shown at T1, T2, T3 and T4 in FIG. 1. Typical spacing is 1½" horizontally upward from the bottom flap scores with succeeding elements spaced at 4½", 5", and 7" each thereafter.

In order substantially to increase the mechanical strength and integrity of the bin, crease lines are formed in the side and end walls. For example, crease lines 45 and 46 are formed in end panel 1 and intersect at point 47. Crease line 45 extends from the lower left hand corner 48 of end panel 1 while crease line 46 extends from the lower right hand corner 49 of panel 1. Furthermore in accordance with a feature of this invention, the point of intersection indicated at 47 is approximately two-thirds the distance from the fold line 33 to the top edge 50 of end panel 1. The point of intersection 51 of crease line 46 with the top edge of end panel 1 is spaced from the point of intersection 52 of crease line 45 with the top edge of end panel 41 by a distance which is approximately equal to one-half the width of end panel 1.

In like fashion crease lines 53 and 54 are formed in side panel 5 and intersect at point 55 which, like point 47, is approximately two-thirds the distance from fold line 20 to the top edge 56 of side panel 5 and the points 57 and 58 are spaced apart by a distance which is approximately one-half the width of side panel 5.

In like fashion crease lines 59 and 60 are formed in end panel 9 and intersect at point 61 while crease lines 62 and 63 are formed in side panel 13 and intersect at point 64. The crease lines formed in end panel 9 and in side panel 13 are related to those panels in a manner which is identical to the relation of the crease lines 45 and 46 with respect to end panel 1 and crease lines 53 and 54 with respect to side panel 5.

Figure 8:
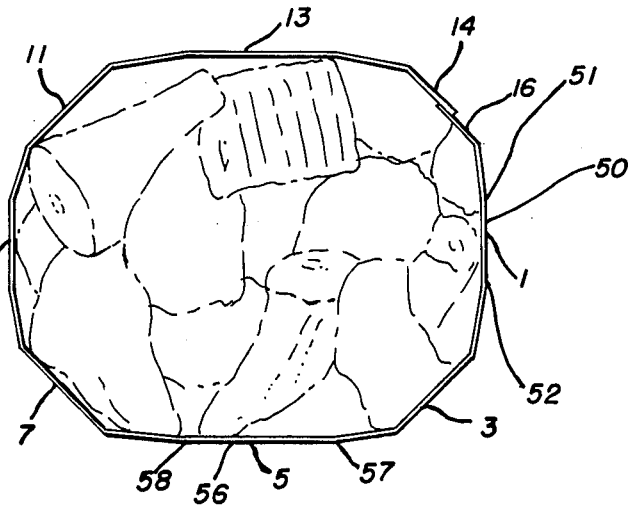

The crease lines contribute substantially to the strength of the bin and result in a container which is octagonal in configuration at its bottom and which when loaded appears as shown in FIG. 8 which includes twice as many angular dispositions of components as are represented by the octagonal structure as shown in FIG. 7. This feature allows the bin to adjust its shape to accommodate the heavy contents which are transported during use of the bin.

INDUSTRIAL APPLICABILITY

This invention is primarily applicable for use in transporting heavy quantities of fabricated cuts of meat on palletized devices from one point to another in a processing plant or from one plant to another. The contents are disposed within a heavy duty very strong plastic bag which is tied off at the top so as to isolate the contents of the bin from the environment.

I claim:

1. A bulk bin formed of a unitary sheet of material comprising one pair each of side and end panels and two pairs of corner panels foldably joined to form a tubular structure of polygonal cross sectional configuration and said tubular structure having closure structure at one end including a pair of primary closure panels foldably joined respectively to the end edges of said side panels at one end thereof, a closure flap foldably joined to an edge of each of said corner panels at said one end of said tubular structure and disposed in flat face contacting relation with one of said primary closure panels, a pair of locking panels having an end edge and a pair of side edges and foldably joined respectively to an edge of each of said end panels at said one end of said tubular structure and folded into flat face contacting relation with said closure flaps and said primary closure panels and interlocked with said primary closure panels so as to secure said closure flaps between said primary closure panels and said locking panels, a pair of diagonal locking slots of hexagonal configuration formed in each of said primary closure panels for respectively receiving locking tabs formed at the corners of different ones of said locking panels, each of said locking panels including a pair of notches each having a base line parallel to the edge of the associated end panel at said one end of said tubular structure and formed in the edge of the associated locking panel remote from the associated end wall to define a pair of corner locking tabs and wherein each of said diagonal locking slots is a generally rectangular configuration having parallel side edges and parallel end edges, the side edge nearest the adjacent edge of the associated side wall being shorter than the other side edge and its ends being connected respectively with the adjacent ends of the end edges to form a pair of truncated corners one of which is approximately parallel to said adjacent edge of the associated side wall and the other of which is approximately perpendicular thereto, a side edge of one locking panel being disposed in abutting coinciding intimate contact with said one truncated corner of an adjacent locking slot and said base line of said one locking panel being disposed in abutting coinciding intimate contact with said other truncated corner of said adjacent locking slot when the locking tab adjacent said side edge of said one locking panel is inserted into said locking slot thereby to enhance stability of the bin.

2. A bulk bin according to claim 1 wherein both side edges of both locking panels are disposed in butting coinciding intimate contact with said one truncated corner of the adjacent locking slot and wherein the base lines of all of said notches are disposed in abutting coinciding intimate contact with said other truncated corner of the adjacent locking slot.

3. A bulk bin formed of a unitary sheet of material comprising one pair of side and end panels and two pairs of corner panels foldably joined to form a tubular structure of polygonal cross sectional configuration and each of said panels being rectangular and having an end edge at one end of said tubular structure, interlocked panels foldably joined to said end edges of said side, end and corner panels respectively and forming a closure for said one end of said tubular structure, and a pair of intersecting crease lines formed in each of said side and end panels, the point of intersection of each pair of crease lines being spaced from said end edge of the associated panel by a distance which is approximately two thirds the height of the associated panel, one end of each of said crease lines coinciding with a corner of each of said side and end panels at said one end of said tubular structure and the other end of each of said crease lines coinciding with the opposite edge of the associated panel.

4. A bulk bin according to claim 3 wherein the ends of each pair of crease lines at said opposite edge of the associated panel are spaced apart by approximately one-half the width of the associated panel.

5. A bulk bin formed of a unitary sheet of material comprising one pair each of side and end panels and two pairs of corner panels foldably joined to form a tubular structure of polygonal cross sectional configuration and said tubular structure having closure structure at one end including a pair of primary closure panels foldably joined respectively to the end edges of said side panels at one end thereof, a closure flap foldably joined to an end edge of each of said corner panels at said one end of said tubular structure and disposed in flat face contacting relation with one of said primary closure panels, a pair of locking panels having an end edge and a pair of side edges and foldably joined respectively to an end edge of each of said end panels at said one end of said tubular structure and folded into flat face contacting relation with said closure flaps and said primary closure panels and interlocked with said primary closure panels so as to secure said closure flaps between said primary closure panels and said locking panels, a pair of diagonal locking slots of hexagonal configuration formed in each of said primary closure panels for respectively receiving locking tabs formed at the corners of different ones of said locking panels, said panels and flaps being formed of corrugated board having board flute tips and an outer board facing and wherein a plurality of bands of reinforcing tape are formed within the corrugated board and disposed outside the board flute tips and along the inner surface of the outer board facing and constitute peripheral reinforcing girdles around the bin.

6. A bulk bin according to claim 5 wherein the vertical spacing between adjacent bands is progressively greater for bands disposed at levels above the level of the second band from the bin bottom.

* * * * *